US008100350B2

(12) United States Patent
Oozono et al.

(10) Patent No.: US 8,100,350 B2
(45) Date of Patent: Jan. 24, 2012

(54) INJECTOR

(75) Inventors: Atsushi Oozono, Kariya (JP); Kazunori Suzuki, Nagoya (JP)

(73) Assignee: Denso Corporation, Kariya (JP)

( * ) Notice: Subject to any disclaimer, the term of this patent is extended or adjusted under 35 U.S.C. 154(b) by 313 days.

(21) Appl. No.: 12/257,668

(22) Filed: Oct. 24, 2008

(65) Prior Publication Data

US 2009/0108102 A1 Apr. 30, 2009

(30) Foreign Application Priority Data

Oct. 30, 2007 (JP) ..... 2007-282242

(51) Int. Cl.
*B05B 1/30* (2006.01)
*F02M 51/00* (2006.01)
*F02M 47/02* (2006.01)

(52) U.S. Cl. ..... 239/585.5; 239/585.1; 239/585.2; 239/533.2; 239/88

(58) Field of Classification Search .... 239/585.1–585.5, 239/233.2–533.15
See application file for complete search history.

(56) References Cited

U.S. PATENT DOCUMENTS 3,442,491 A * 5/1969 Messerschmidt ..... 251/367
4,007,880 A * 2/1977 Hans et al. ..... 239/585.5
4,525,910 A * 7/1985 Boehmer ..... 29/890.127
4,925,111 A * 5/1990 Foertsch et al. ..... 239/533.12
6,267,307 B1 * 7/2001 Pontoppidan ..... 239/585.4
6,575,142 B2 * 6/2003 Kurz et al. ..... 123/472
6,772,965 B2 * 8/2004 Yildirim et al. ..... 239/533.3
6,988,681 B2 * 1/2006 Reiter ..... 239/584
2005/0067512 A1 * 3/2005 Shimizu et al. ..... 239/585.1

FOREIGN PATENT DOCUMENTS

JP 2002-364498 12/2002
JP 2003-214294 7/2003
JP 2003214294 A * 7/2003
JP 2006-329147 12/2006

OTHER PUBLICATIONS

Japanese Office Action dated Aug. 25, 2009, issued in corresponding Japanese Application No. 2007-282242, with English translation.

* cited by examiner

*Primary Examiner* — Len Tran
*Assistant Examiner* — James Hogan
(74) *Attorney, Agent, or Firm* — Nixon & Vanderhye, PC

(57) ABSTRACT

An injector includes a valve body, a needle valve, and a thermal expansion member. The valve body includes an internal space and a bottom portion having a nozzle hole. One end side of the space is covered with the bottom portion. The needle valve is accommodated in the space such that a fuel passage leading to the hole is formed between an inner surface of the valve body and an outer surface of the needle valve. The passage is opened or closed with respect to the hole by movement of the needle valve, so fuel injection is started or stopped. The inner surface of the bottom portion is opposed to a one end surface of the needle valve. The member is attached on the one end surface. The member is made of a material having a larger coefficient of thermal expansion than a material of the needle valve.

3 Claims, 6 Drawing Sheets

INJECTOR

CROSS REFERENCE TO RELATED APPLICATION

This application is based on and incorporates herein by reference Japanese Patent Application No. 2007-282242 filed on Oct. 30, 2007.

BACKGROUND OF THE INVENTION

1. Field of the Invention

The present invention relates to an injector, which injects and supplies fuel into an engine.

2. Description of Related Art

An injector, which injects fuel directly into an combustion chamber of an engine, conventionally has the following configuration. As shown in FIG. 6A to FIG. 6C, a conventional injector 100 includes a valve body 102, which defines a internal space 101 having a generally cylindrical shape, and a needle valve 103, which is received in the internal space 101 and moves in its axial direction.

The internal space 101 is covered with a bottom 105 of the valve body 102, through which a nozzle hole 104 penetrates. The valve body 102 accommodates the needle valve 103 in the internal space 101. Accordingly, a fuel passage 106 leading into a nozzle hole 104 is defined between an inner circumferential surface of the valve body 102 and an outer circumferential surfaces of the needle valve 103. The injector 100 starts or stops injection of fuel by opening or closing the fuel passage 106 with respect to the nozzle hole 104 as a result of the movement of the needle valve 103.

According to the injector 100, even though the fuel passage 106 is closed with respect to the nozzle hole 104 by the needle valve 103, an internal space (hereinafter referred to as a bottom chamber 108) under a bottom face 107 of the needle valve 103 always communicates with a combustion chamber through the nozzle hole 104. Consequently, high-temperature combustion gas enters into the bottom chamber 108 via the nozzle hole 104, thereby carbonizing residual fuel on the bottom face 107 (see FIG. 6B). As a result, deposits accumulate on the bottom face 107 so as to hinder the injection of fuel, and thus spray characteristics of the injector 100 may fluctuate (see FIG. 6C).

According to conventional technologies, by applying a coating of a fluorine system to the whole bottom-side surface of the needle valve 103 including the bottom face 107, exfoliation of fuel from the bottom face 107 is promoted, so that fuel does not remain on the bottom face 107. However, fuel cannot completely be prevented from remaining on the bottom face 107. Therefore, the problem that residual fuel is carbonized to become deposits cannot be fully resolved, so measures against the accumulation of deposits need to be separately taken.

According to a technology described in JP2006-329147A, a coating of a fluorine system or the like is applied in a streaked manner to a certain area of a wall surface of a nozzle hole, and then deposits accumulated on the wall surface of the nozzle hole are sheared off to be removed using a difference in a coefficient of thermal expansion between a coated area and an uncoated area of the wall surface. Nevertheless, it is extremely complicated to apply a coating only to the area of one surface where the coating is needed, separately from the area where the coating is not needed. Moreover, shear force in the coated area is not very strong, and therefore it is unknown whether an effect, which is worth the complicated coating operations, is produced.

SUMMARY OF THE INVENTION

The present invention addresses the above disadvantages. Thus, it is an objective of the present invention to limit accumulation of deposits on a bottom face of a needle valve in an injector, which injects and supplies fuel.

To achieve the objective of the present invention, there is provided an injector including a valve body, a needle valve and a thermal expansion member. The valve body includes an internal space having a generally cylindrical shape and a bottom portion having a nozzle hole, which penetrates through the bottom portion. One end side of the internal space is covered with the bottom portion of the valve body. The nozzle hole opens on an inner surface of the bottom portion of the valve body. The needle valve is accommodated in the internal space such that a fuel passage leading to the nozzle hole is formed between an inner circumferential surface of the valve body and an outer circumferential surface of the needle valve. The needle valve is configured to be movable in an axial direction of the internal space. The fuel passage is formed to be opened or closed with respect to the nozzle hole as a result of the movement of the needle valve, so that injection of fuel is started or stopped, respectively. The inner surface of the bottom portion is opposed to a one end surface of the needle valve. The thermal expansion member is attached on the one end surface of the needle valve. The thermal expansion member is made of a material, which has a larger coefficient of thermal expansion than a material of the needle valve.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An injector of a first embodiment of the invention includes a valve body, which defines an internal space having a generally cylindrical shape, and a needle valve, which is received in the internal space to be moved in its axial direction. A bottom side of the internal space is covered with a bottom of the valve body, through which a nozzle hole penetrates. By the valve body receiving the needle valve in its internal space, a fuel passage leading into the nozzle hole is formed between its own inner circumferential surface and an outer circumferential surfaces of the needle valve. The injector starts or stops injection of fuel by opening or closing the fuel passage with respect to the nozzle hole by the movement of the needle valve.

In such an injector, the nozzle hole opens on an inner surface of the bottom of the valve body, and this inner surface is opposed to the bottom face of the needle valve. The thermal expansion member that is made of a material having a larger coefficient of thermal expansion than the material of the needle valve is attached on the bottom face of the needle valve. A recess recessed in an opposite direction of the bottom of the valve body is formed on the bottom face of the needle valve, and the thermal expansion member is received in the recess. The thermal expansion member is attached by welding on the bottom face of the needle valve.

According to an injector of a second embodiment of the invention, a thermal expansion member has a slit on its bottom side surface opposed to the inner surface of the bottom of the valve body.

First Embodiment (Constitution of the First Embodiment)

A configuration of an injector 1 of the first embodiment is explained below with reference to FIG. 1. The injector 1 is disposed, for example, in each cylinder of a gasoline engine (not shown) to inject fuel directly into a combustion chamber (not shown). The injector 1 receives fuel pressurized to a high pressure of 2 MPa, for example, to inject the fuel into the combustion chamber so as to form a fuel spray. The fuel spray formed in the combustion chamber is combusted as a result of spark discharge so as to generate an output.

Figure 1:
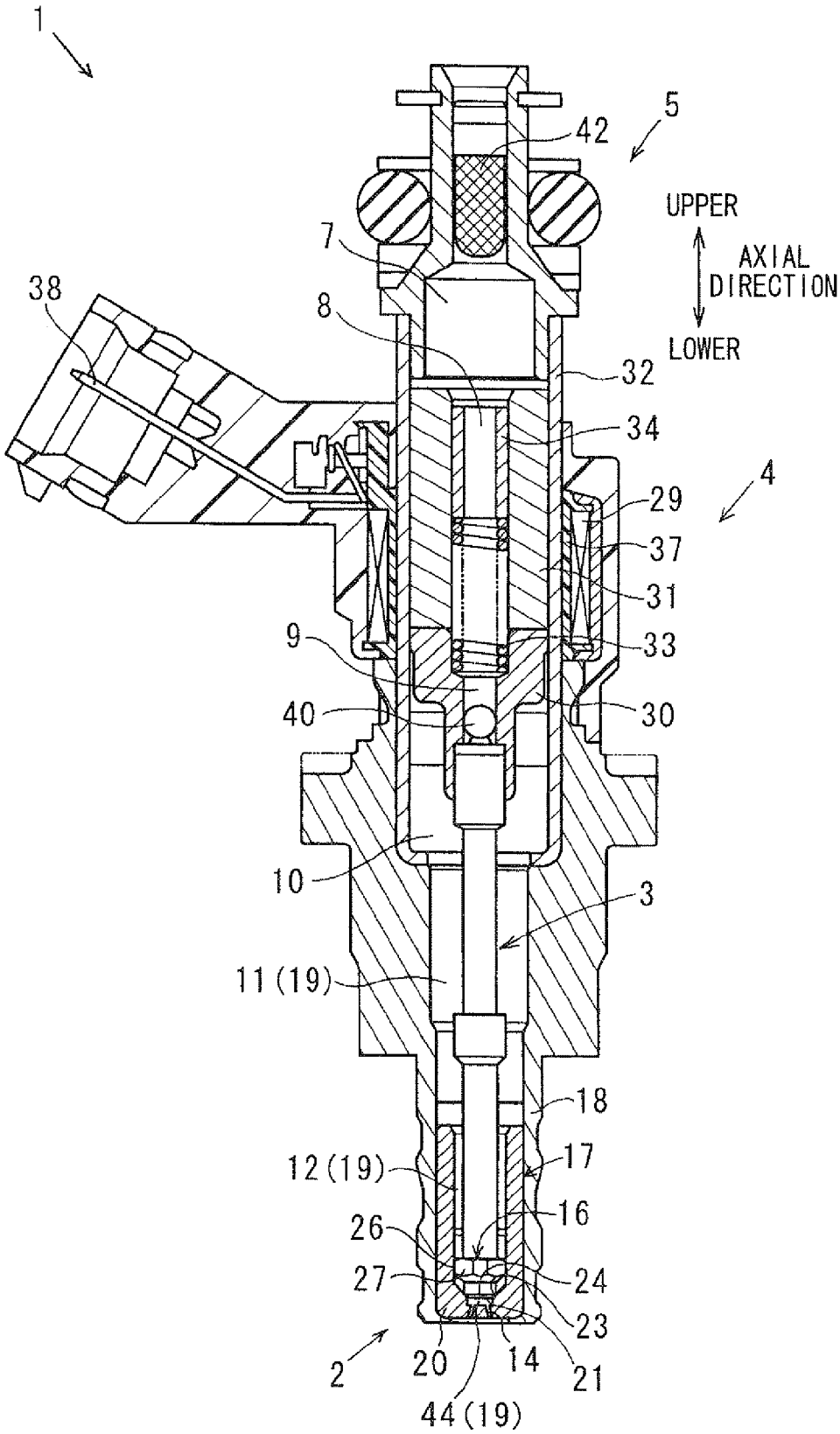
FIG. 1 is a diagram illustrating an entire configuration of an injector in accordance with a first embodiment of the invention.

As shown in FIG. 1, the injector 1 includes a nozzle part 2, which injects fuel, an electromagnetic solenoid part 4, which drives a valve body (needle valve 3) of the nozzle part 2, and a fuel receiving part 5, which receives high-pressure fuel. Fuel received through the fuel receiving part 5 is led to the lower side through fuel passages 7 to 12, which are formed inside the injector 1, and then the injector 1 injects the fuel through a nozzle hole 14 by driving the needle valve 3.

The nozzle part 2 includes the needle valve 3, which functions as a needlelike valve body, a needle supporting member 17 having a cup shape, which has the nozzle hole 14 in its lower end and accommodates a sliding shaft part 16 of the needle valve 3 to slidably support the shaft part 16, and a nozzle body 18, which receives the needle valve 3 and the needle supporting member 17.

The needle supporting member 17 and the nozzle body 18 constitute a valve body, which defines an internal space 19 having a generally cylindrical shape, and the needle valve 3 is received in the internal space 19 so that the needle valve 3 moves in its axial direction. A bottom part of the internal space 19 is blocked with a bottom 20 of the needle supporting member 17, and the nozzle hole 14 penetrates through the bottom 20. By receiving the needle valve 3 in their internal space 19, the needle supporting member 17 and the nozzle body 18 define respective fuel passages 12, 11, which lead into the nozzle hole 14, between their inner circumferential surfaces and an outer circumferential surfaces of the needle valve 3.

A seat surface 23 having an annular and tapered shape and surrounding an axial center of the needle supporting member 17 and the nozzle body 18 is formed on an inner surface of the bottom 20, which is opposed to a bottom face 21 of the needle valve 3. An annular seat part 24, which approaches or separates from the seat surface 23, is formed on the bottom face 21. When the seat part 24 approaches or separates from the seat surface 23, the fuel passage 12 is closed or opened with respect to the nozzle hole 14.

A sliding contact surface 26, which is in sliding contact with an inner circumferential surface of the needle supporting member 17, and a flat surface 27, which is not in sliding contact with an inner circumferential surface of the needle supporting member 17, are provided alternately on an outer circumferential surface of the sliding shaft part 16. A passage of fuel is formed between the inner circumferential surface of the needle supporting member 17 and the flat surface 27, and the passage of fuel serves as a part of the fuel passage 12.

An electromagnetic solenoid part 4 includes a solenoid coil 29, which generates magnetic attraction force upon energization, a movable core 30, which is magnetically attracted to the upper side as a result of the energization of the solenoid coil 29, a fixed core 31, which is fixed to an upper side of the movable core 30 with a predetermined gap formed between the movable core 30 and the fixed core 31 and magnetically attracts the movable core 30, a core accommodating member 32, which slidably supports and accommodates the movable core 30, and which fixes and accommodates the fixed core 31, a coil spring 33 as a restitution spring, which urges the movable core 30 to the lower side, and a gap adjustment member 34, which adjusts the gap between the movable core 30 and the fixed core 31.

The solenoid coil 29 is formed by winding many coil wires around a cylindrical bobbin 37 made of resin, and electric power is supplied to the coil 29 from an in-vehicle power source (not shown) through a connector terminal 38.

The movable core 30 is formed to be a cylindrical object having a smaller diameter toward the lower side in a stepwise manner. An upper end portion of the movable core 30 is slidably held by the core accommodating member 32, and an upper end portion of the needle valve 3 is held in a lower end portion of the movable core 30. Accordingly, the movable core 30 is moved in the axial direction together with the needle valve 3.

An outer circumferential surface of the movable core 30 defines the fuel passage 10 together with an inner circumferential surface of the core accommodating member 32 and an upper outer circumferential surface of the needle valve 3. The fuel passage 10 communicates with the fuel passage 11 through a lower end opening part of the core accommodating member 32. An inner circumferential surface of the movable core 30 defines the fuel passage 9, and the fuel passage 9 communicates with the fuel passage 10 via a through hole 40 passing through the movable core 30 in its radial direction.

The fixed core 31 is formed in a cylindrical shape, and its outer circumference side is fixed to the core accommodating member 32. An inner circumference side of the fixed core 31 defines the fuel passage 8, in which the coil spring 33 and the gap adjustment member 34 are received. The coil spring 33 is received in the fuel passage 8 such that its lower end portion is supported in an inner circumference of the movable core 30 and its upper end portion is supported by the gap adjustment member 34. The gap adjustment member 34 adjusts the gap between the movable core 30 and the fixed core 31 so as to determine a lift amount of the needle valve 3 (i.e. an amount of separation of the seat part 24 from the seat surface 23 in the axial direction).

The fuel receiving part 5 includes a fuel passage 7, which communicates with the fuel passage 8, and conducts fuel from the outside into the fuel passage 7 through a filter 42.

As a result of the above configuration, the injector 1 leads the high-pressure fuel received from the outside into the nozzle hole 14 through the fuel passages 7 to 12 in this order. Upon energization of the solenoid coil 29, the injector 1 drives the movable core 30 and the needle valve 3 in the upper direction so as to disengage the seat part 24 from the seat surface 23. Accordingly, the injector 1 injects fuel through the nozzle hole 14 to form a fuel spray in a combustion chamber, by opening the fuel passage 12 with respect to the nozzle hole 14.

When the energization of the solenoid coil 29 is stopped, the injector 1 drives the movable core 30 and the needle valve 3 in the lower direction by urging force of the coil spring 33 so as to engage the seat part 24 with the seat surface 23. Accordingly, the injector 1 stops the injection of fuel by closing the fuel passage 12 with respect to the nozzle hole 14.

After the fuel passage 12 is closed with respect to the nozzle hole 14 by the needle valve 3, the fuel spray is combusted as a result of spark discharge, so that output power is generated and high-temperature combustion gas is generated. The combustion gas enters through the nozzle hole 14 into the internal space 19 on a lower side of the bottom face 21 (hereinafter referred to as a bottom chamber 44). As a result, residual fuel on the bottom face 21 may be carbonized to be deposits (see FIG. 3A and FIG. 3B).

The start and stop of the energization of the solenoid coil 29 are carried out in response to a command from a predetermined electronic control unit (ECU: not shown) in a vehicle. The ECU performs the command to start and stop the energization based on various detection values such as an engine rotation speed and an accelerator opening.

(Characteristics of the First Embodiment)

Figure 2A:
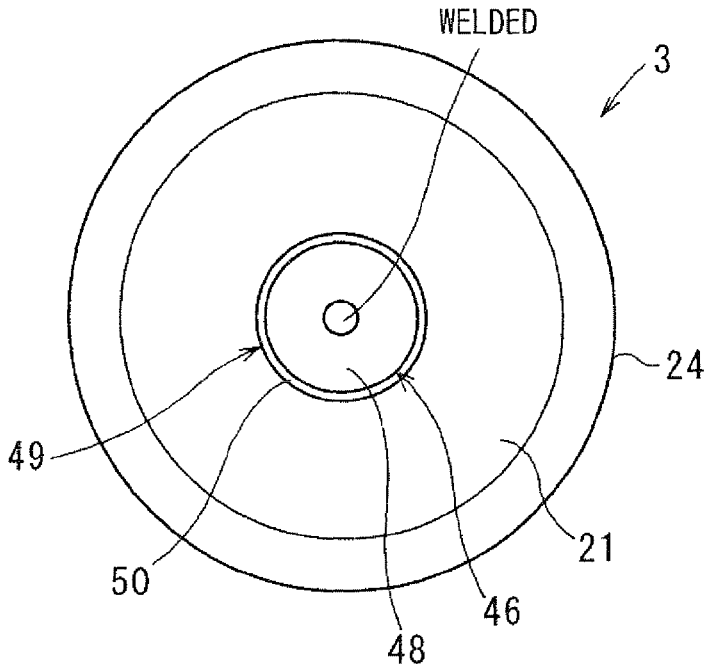
FIG. 2A is a bottom view illustrating a needle valve in accordance with the first embodiment.
Figure 2B:
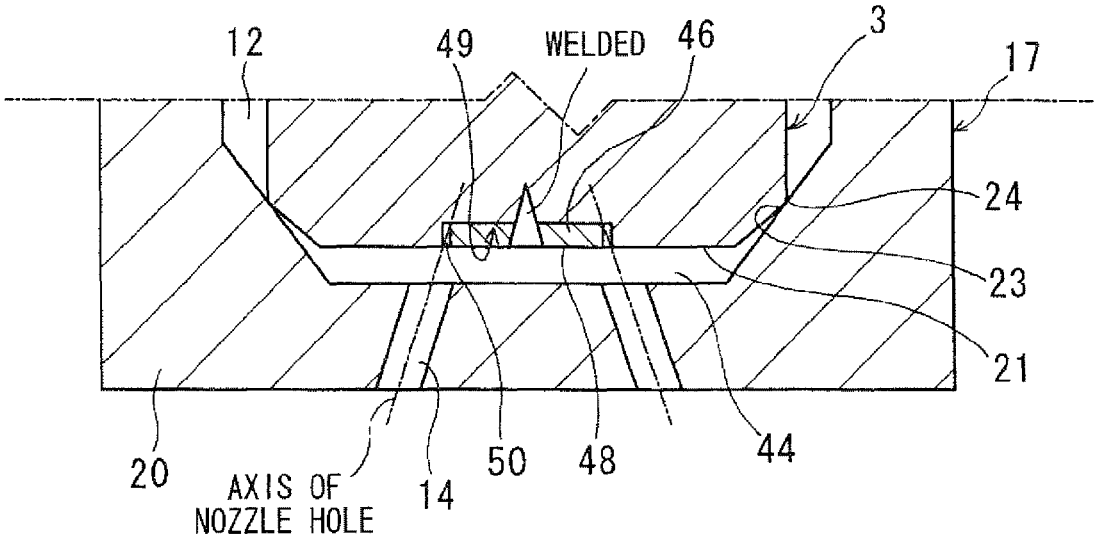
FIG. 2B is a diagram illustrating a cross section of a bottom of the injector in accordance with the first embodiment.

Characteristics of the injector 1 of the first embodiment are described below with reference to FIG. 2A and FIG. 2B. According to the injector 1, as shown in FIG. 2A and FIG. 2B, a thermal expansion member 46 that is made of a material having a larger coefficient of thermal expansion than a material, from which the needle valve 3 is formed, is attached on the bottom face 21 of the needle valve 3. The needle valve 3 is made of stainless steel, and the thermal expansion member 46 is formed from metal having a larger coefficient of thermal expansion than stainless steel, including aluminium or lead, for example.

The thermal expansion member 46 is formed in the shape of a disk, and its bottom side surface 48 has a circular shape. The thermal expansion member 46 is received in a round recess 49, which is recessed in an opposite direction of the bottom 20 on the bottom face 21. An inner diameter of the recess 49 is larger than an outer diameter of the thermal expansion member 46, and an annular clearance 50 is formed between an inner peripheral wall of the recess 49 and an outer circumferential wall of the thermal expansion member 46.

Figure 3A:
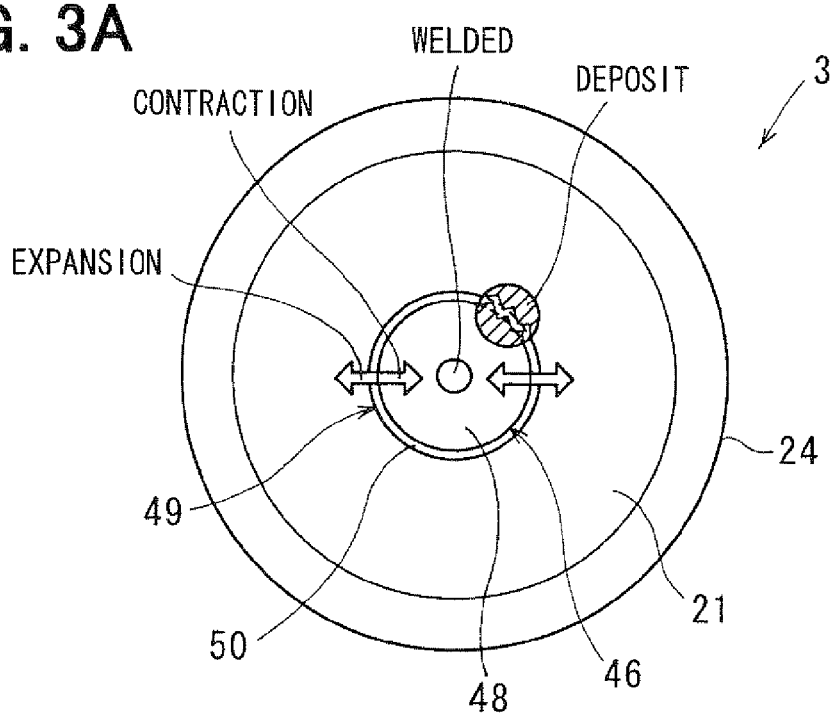
FIG. 3A is a bottom view of the needle valve illustrating a shear of deposits in accordance with the first embodiment.
Figure 3B:
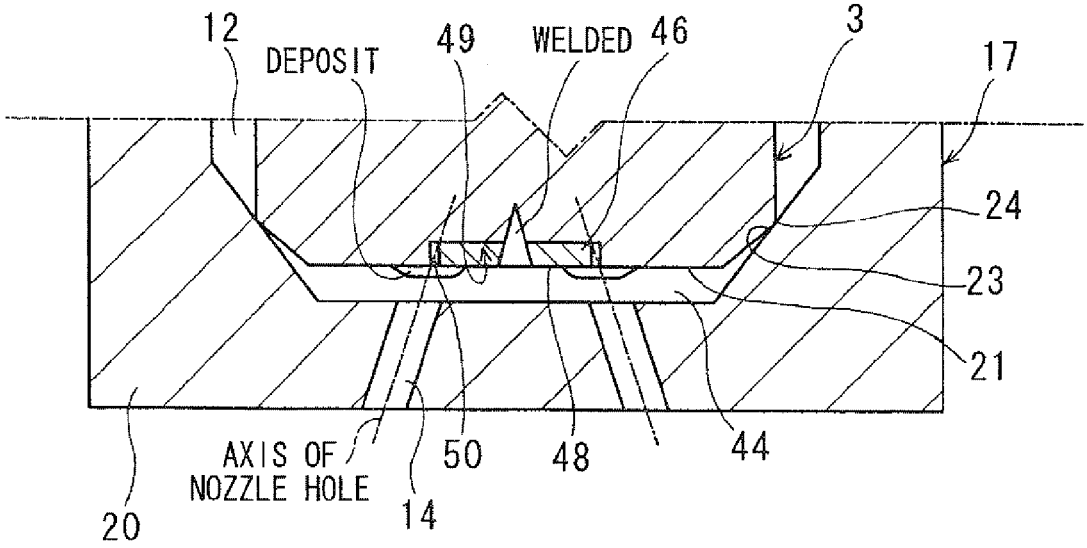
FIG. 3B is a diagram illustrating a cross section of the bottom of the injector on which deposits are attached in accordance with the first embodiment.

The recess 49 is formed such that the clearance 50 is located on an axis of the nozzle hole 14. Accordingly, high-temperature combustion gas, which has entered into the bottom chamber 44 through the nozzle hole 14, first collides with the bottom face 21 and the bottom side surface 48 near the clearance 50, and then spreads across the bottom chamber 44. Thus, as shown in FIG. 3A and FIG. 3B, the deposits are easily formed on the bottom face 21 and the bottom side surface 48 with the clearance 50 therebetween. The clearance 50 is chosen from a range of several micrometers to several tens of micrometers according to a diameter of the spread of the deposits.

The bottom side surface 48 and the bottom face 21 are arranged so as to form generally the same plane without producing a level difference therebetween. The thermal expansion member 46 is attached on the bottom face 21 by welding, and the welding position is the center of the bottom side surface 48.

(Workings of the First Embodiment)

Workings of the injector 1 of the first embodiment are described below with reference to FIG. 3A and FIG. 3B. Due to the entering of combustion gas into the bottom chamber 44, the thermal expansion member 46 is heated to expand more greatly than the bottom of the needle valve 3 expands, and a diameter of the bottom side surface 48 is increased, so that the clearance 50 is reduced. Moreover, due to the emission of combustion gas or the injection of fuel, the thermal expansion member 46 is cooled to contract more greatly than the bottom of the needle valve 3 contracts. Accordingly, the diameter of the bottom side surface 48 is decreased back to its original diameter, and the clearance 50 also recovers its original size.

Due to repetition of the above expansion and contraction of the thermal expansion member 46, the deposits accumulated astride between the bottom face 21 and the bottom side surface 48 are strongly sheared off, and thereby the exfoliation of the deposits from the bottom face 21 or the bottom side surface 48 is promoted.

(Advantageous Effects of the First Embodiment)

According to the injector 1 of the first embodiment, the nozzle hole 14 opens on an inner surface of the bottom 20 of the needle supporting member 17, and this inner surface is opposed to the bottom face 21 of the needle valve 3. The thermal expansion member 46 that is made of a material having a larger coefficient of thermal expansion than the material of the needle valve 3 is attached on the bottom face 21. Accordingly, due to the difference in expansion and contraction between the thermal expansion member 46 and the needle valve 3, the deposits accumulated astride between the bottom side surface 48 of the thermal expansion member 46 and the bottom face 21 are strongly sheared off, and thereby the exfoliation of the deposits from the bottom face 21 or the bottom side surface 48 is promoted. As a result, the accumulation of the deposits on the bottom face 21 is limited.

The thermal expansion member 46 has, for example, a thickness of 10 micrometers or more. Shear force based on expansion or contraction of the thermal expansion member 46 is much greater than shear force of a conventional coating that has a thickness of several micrometers or below. Accordingly, an effect of limiting the accumulation of the deposits on the bottom face 21 of the needle valve 3 is expected, the above effect being worth the work on the attachment of the thermal expansion member 46, compared to a case where the conventional coating is partly applied.

The recess 49 recessed in an opposite direction of the bottom 20 is formed on the bottom face 21, and the thermal expansion member 46 is received in the recess 49. Accordingly, the bottom face 21 and bottom side surface 48 are arranged to have generally the same plane without producing a level difference therebetween. As a result, a variation of injection quantity based on turbulence of a flow of fuel, which is caused by the level difference, is limited.

The thermal expansion member 46 is attached on the bottom face 21 by welding, and the welding position is the center of the bottom side surface 48. In addition, the welding position may be a center of gravity of the thermal expansion member 46. Accordingly, the thermal expansion member 46 is expanded and contracted evenly generally without imbalance in its whole circumference.

The recess 49 is formed such that the clearance 50 is located on an axis of the nozzle hole 14. Accordingly, the deposits are easily formed on the bottom face 21 and the bottom side surface 48 with the clearance 50 therebetween. As a result, the deposits are accumulated on an area where a shearing-exfoliating effect is great, and thus, the accumulation of the deposits is efficiently limited.

Second Embodiment

Figure 4A:
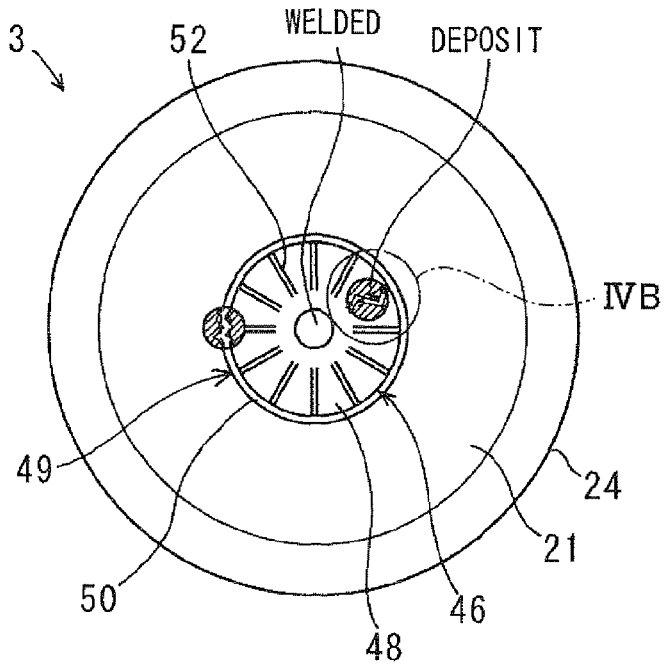
FIG. 4A is a bottom view of a needle valve illustrating a shear of deposits in accordance with a second embodiment of the invention.
Figure 4B:
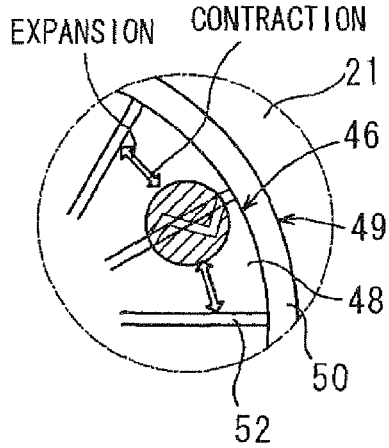
FIG. 4B is an enlarged view illustrating a surrounding area of deposits accumulated astride a slit in FIG. 4A in accordance with the second embodiment.
Figure 4C:
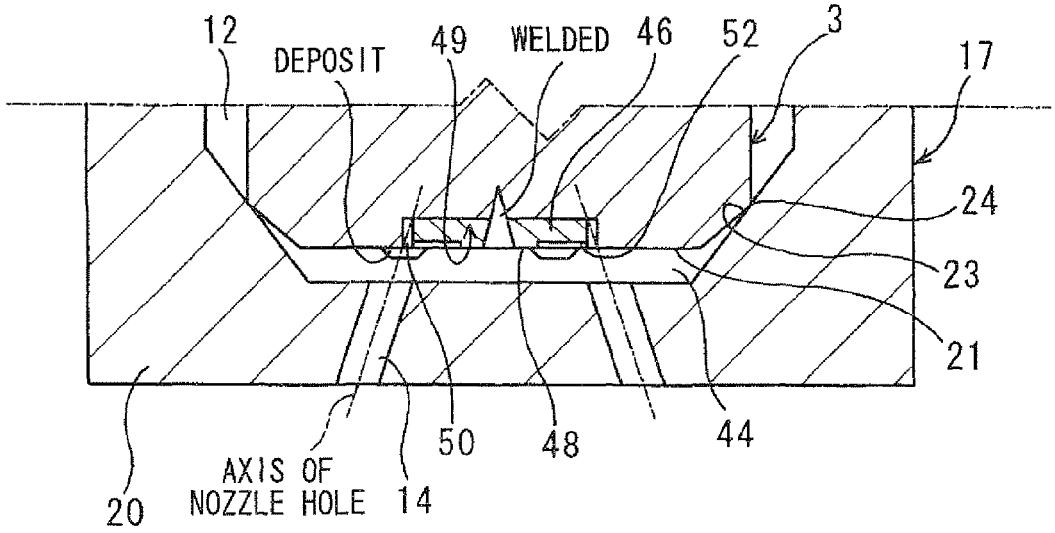
FIG. 4C is a diagram illustrating a cross section of a bottom of an injector on which deposits are attached in accordance with the second embodiment.

According to an injector 1 of the second embodiment, as shown in FIG. 4A to FIG. 4C, slits 52 are formed radially on a bottom side surface 48 of a thermal expansion member 46. Accordingly, when deposits are accumulated astride the slit 52 on the bottom side surface 48, the deposits are sheared and the exfoliation of the deposits from the bottom side surface 48 is promoted, due to expansion and contraction of the thermal expansion member 46 near (the edge of the slit 52. As a result, the exfoliation of the deposits not astride between a bottom face 21 and the bottom side surface 48 is also promoted.

Third Embodiment

Figure 5A:
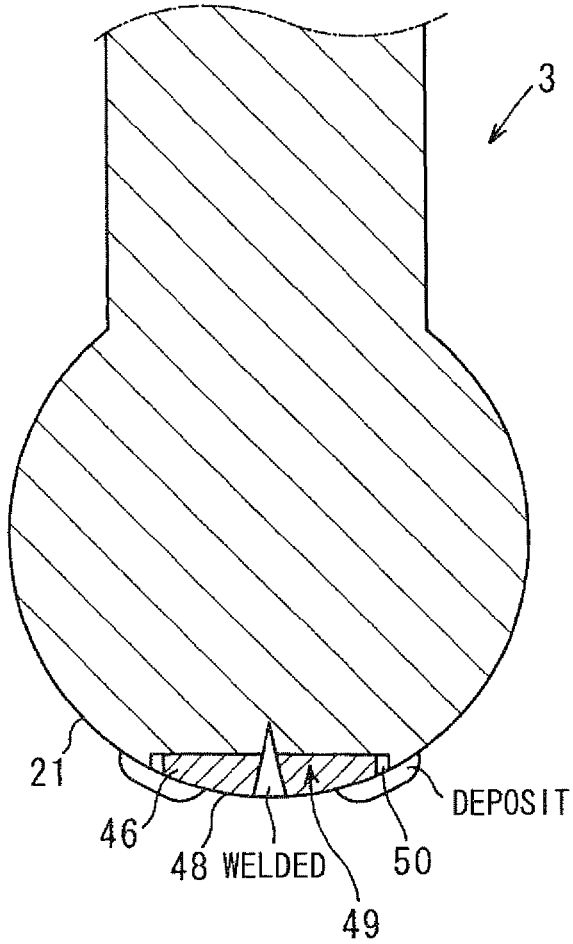
FIG. 5A is a diagram illustrating a cross section of a bottom of a needle valve in accordance with a third embodiment of the invention.
Figure 5B:
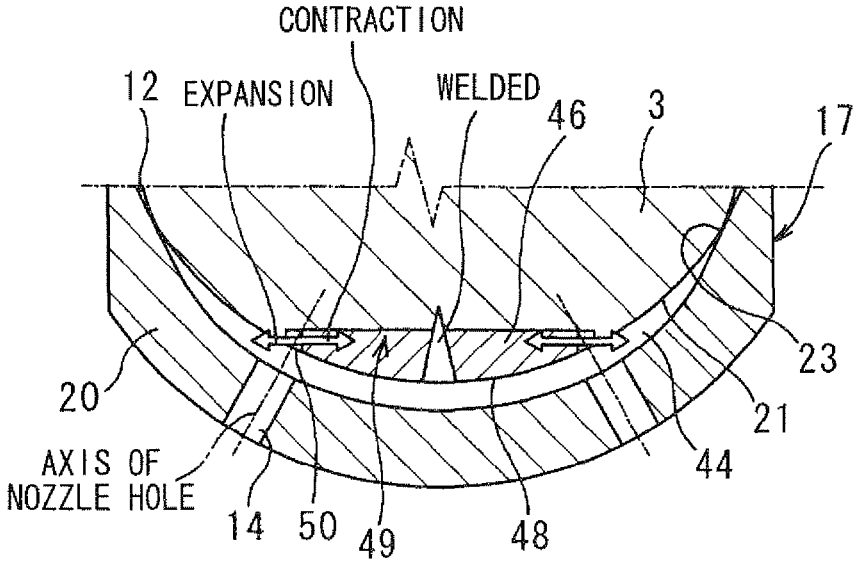
FIG. 5B is an illustration diagram of a cross section of a bottom of an injector illustrating expansion and contraction of a thermal expansion member in accordance with the third embodiment.
Figure 6A:
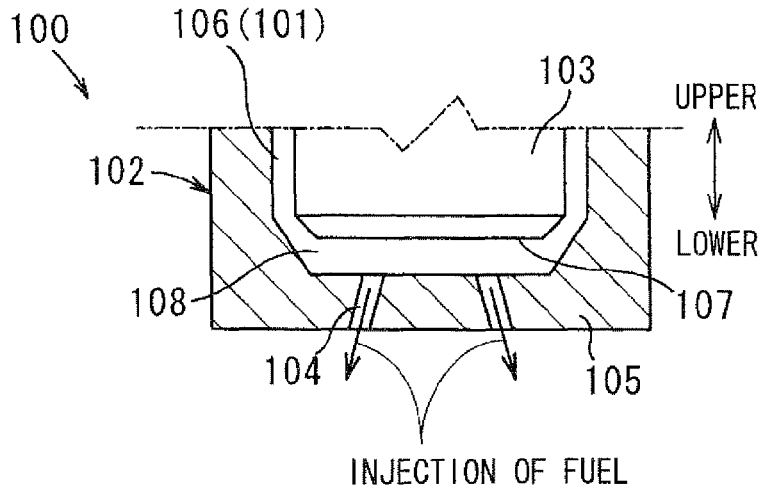
FIG. 6A PRIOR ART
FIG. 6A is an illustration diagram of a cross section of a bottom of a previously proposed injector illustrating injection of fuel.
Figure 6B:
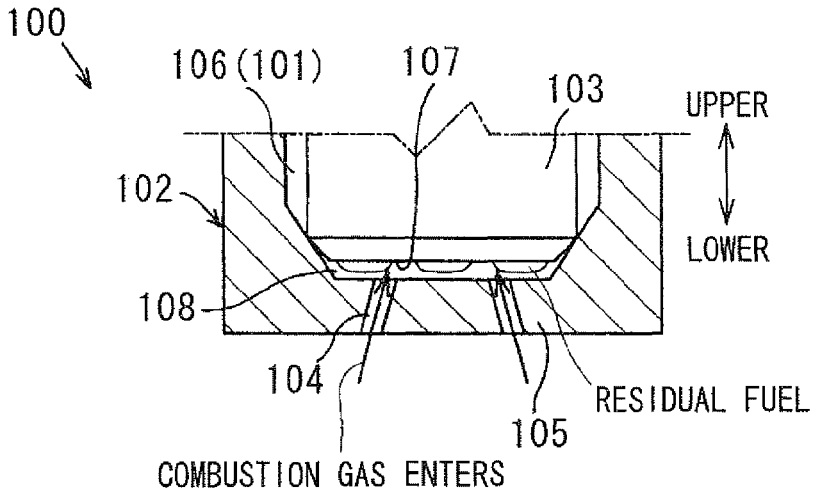
FIG. 6B PRIOR ART
FIG. 6B is an illustration diagram of the cross section of the bottom of the previously proposed injector illustrating entering of combustion gas.
Figure 6C:
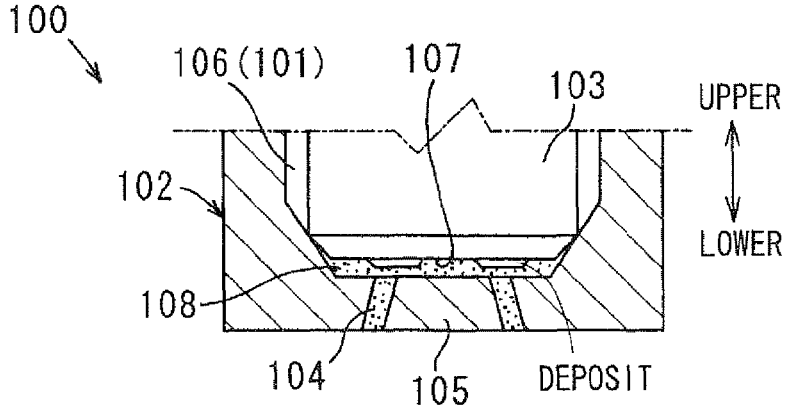
FIG. 6C PRIOR ART
FIG. 6C is an illustration diagram of the cross section of the bottom of the previously proposed injector illustrating accumulation of deposits.

According to an injector 1 of a third embodiment of the invention, as shown in FIG. 5A and FIG. 5B, a bottom face 21 of a needle valve 3 and an inner surface of a bottom 20 including a seat surface 23 are spherically formed. When the bottom face 21 annularly disengages from or engages the seat surface 23, a fuel passage 12 and a nozzle hole 14 communicate, or the communication between them is blocked, respectively.

A thermal expansion member 46 is formed in a shape of a disk with its bottom side surface 48 swollen in a spherical surface shape, and is received in a round recess 49, which is recessed in an opposite direction of the bottom 20 at a lowermost part of the bottom face 21. An inner diameter of the recess 49 is larger than an outer diameter of the thermal expansion member 46, and an annular clearance 50 is formed between an inner peripheral wall of the recess 49 and an outer circumferential wall of the thermal expansion member 46. The recess 49 is formed such that the clearance 50 is located on an axis of the nozzle hole 14.

The bottom side surface 48 is a spherical surface edged in a circle, and the bottom side surface 48 and the bottom face 21 are arranged so as to form generally the same spherical surface without producing a level difference therebetween. The thermal expansion member 46 is attached on the bottom face 21 by welding, and the welding position is the center of the bottom side surface 48.

Additional advantages and modifications will readily occur to those skilled in the art. The invention in its broader terms is therefore not limited to the specific details, representative apparatus, and illustrative examples shown and described.

What is claimed is:

1. An injector comprising:

a valve body that includes an internal space having a generally cylindrical shape and a bottom portion having a nozzle hole, which penetrates through the bottom portion, wherein:

one end side of the internal space is covered with the bottom portion of the valve body; and the nozzle hole opens on an inner surface of the bottom portion of the valve body;

a needle valve accommodated in the internal space such that a fuel passage leading to the nozzle hole is formed between an inner circumferential surface of the valve body and an outer circumferential surface of the needle valve, wherein:

the needle valve is configured to be movable in an axial direction of the internal space;

the fuel passage is formed to be opened or closed with respect to the nozzle hole as a result of the movement of the needle valve, so that injection of fuel is started or stopped, respectively; and the inner surface of the bottom portion is opposed to one end surface of the needle valve; and a thermal expansion member attached on the one end surface of the needle valve, wherein the thermal expansion member is made of a material, which has a larger coefficient of thermal expansion than a material of the needle valve, wherein:

the one end surface of the needle valve has a recess defined therein;

the recess is recessed in a direction away from the bottom portion of the valve body;

the thermal expansion member is accommodated in the recess;

the inner surface of the bottom portion includes a seat surface;

the needle valve includes a seat part, which is engageable with the seat surface to stop the fuel injection from the nozzle hole;

the recess is formed radially inward of the seat part of the needle valve;

the thermal expansion member is adapted to radially expand or contract relative to an inner peripheral surface of the recess to decrease or increase a clearance defined radially between the thermal expansion member and the inner peripheral surface of the recess, in response to a change in a temperature of the thermal expansion member; and a radially inner part of the thermal expansion member is securely fixed to a bottom surface of the recess, and a radially outer part of the thermal expansion member is not fixed to the bottom surface of the recess to enable radial displacement of the radially outer part of the thermal expansion member relative to the inner peripheral surface of the recess.

2. The injector according to claim 1, wherein the thermal expansion member is attached on the one end surface of the needle valve by welding.

3. The injector according to claim 1, wherein:

the thermal expansion member includes a slit on a bottom side surface thereof; and the bottom side surface is opposed to the inner surface of the bottom portion of the valve body.

* * * * *